US008276486B2

(12) United States Patent
Hsieh

(10) Patent No.: US 8,276,486 B2
(45) Date of Patent: Oct. 2, 2012

(54) HINGE ASSEMBLY, HAND TOOL AND PLIERS

(75) Inventor: Chih-Ching Hsieh, Taichung County (TW)

(73) Assignee: Chihching Hsieh, Taichung County (TW)

( * ) Notice: Subject to any disclaimer, the term of this patent is extended or adjusted under 35 U.S.C. 154(b) by 335 days.

(21) Appl. No.: 12/752,140

(22) Filed: Apr. 1, 2010

(65) Prior Publication Data

US 2011/0239833 A1 Oct. 6, 2011

(51) Int. Cl.
*B25B 23/16* (2006.01)
*B25B 7/18* (2006.01)

(52) U.S. Cl. ..... 81/424; 81/177.8; 81/427.5

(58) Field of Classification Search ..... 81/424, 81/177.6, 177.7, 177.8, 393, 427.5; 16/250, 16/297, 319, 343
See application file for complete search history.

(56) References Cited

U.S. PATENT DOCUMENTS 657,424 A * 9/1900 Ketchum ..... 81/134
879,525 A * 2/1908 Cook ..... 81/177.8
1,670,188 A * 5/1928 Castelli ..... 81/3.44
1,924,023 A * 8/1933 Carlberg ..... 81/77
2,921,773 A * 1/1960 Hoelzer ..... 254/129
3,068,728 A * 12/1962 Shepherd ..... 81/177.7
5,280,738 A * 1/1994 Liou ..... 81/20
5,515,754 A * 5/1996 Elkins ..... 81/177.9
5,797,300 A * 8/1998 Fairbanks ..... 81/60
6,000,302 A * 12/1999 Chiang ..... 81/177.8
6,016,726 A * 1/2000 Wright ..... 81/177.7
6,053,076 A * 4/2000 Barnes ..... 81/60
6,257,103 B1 * 7/2001 Yu ..... 81/177.6
6,382,058 B1 * 5/2002 Owoc ..... 81/177.9
6,412,373 B1 * 7/2002 Hsiao ..... 81/177.7
6,745,650 B1 * 6/2004 Chang ..... 81/177.8
7,051,625 B1 * 5/2006 Lee ..... 81/177.8
7,059,220 B1 * 6/2006 Liou ..... 81/124.5
7,197,966 B1 * 4/2007 Hsieh ..... 81/177.9
7,735,399 B2 * 6/2010 Robinson et al. ..... 81/177.8
7,987,744 B2 * 8/2011 Hanning et al. ..... 81/9.43
2003/0061915 A1 * 4/2003 Wang ..... 81/177.6
2007/0163401 A1 * 7/2007 Hsieh ..... 81/177.7

* cited by examiner

*Primary Examiner* — David B Thomas
(74) *Attorney, Agent, or Firm* — CKC & Partners Co., Ltd.

(57) ABSTRACT

A hinge assembly includes a hinge and a detent cover. The hinge pivotally connects a first acting member to a second acting member. The detent cover can cover the hinge to stop the rotational motion between the first acting member and the second acting member.

10 Claims, 15 Drawing Sheets

100

100

100

HINGE ASSEMBLY, HAND TOOL AND PLIERS

BACKGROUND

1. Technical Field

The present disclosure relates to hand tools.

2. Description of Related Art

Hand tools are the most common tools of general home and factory. Hand tools include pliers, wrenches, screwdrivers, hammers and so on.

In normal operation, hand tools must be applied to a variety of work pieces. However, the work pieces are located at different positions respectively. Therefore, users often change the acting angle between the hand tool and the work piece with their wrist, which leads to wrist injury.

SUMMARY

According to one embodiment, a hinge assembly includes a hinge and a detent cover. The hinge pivotally connects a first acting member to a second acting member. The detent cover can cover the hinge to stop the rotational motion between the first acting member and the second acting member.

According to another embodiment, a hand tool includes a handle, an acting member, a hinge and a detent cover. The hinge pivotally connects the handle to the acting member. The detent cover can cover the hinge stop the rotational motion between the handle and the acting member.

According to yet another embodiment, a pair of pliers includes a first lever, a second lever and at least one detent cover. The second lever is pivotally connected to the first lever. The second lever includes a jaw, a handle and a hinge. The hinge pivotally connects the jaw to the handle. The detent cover can cover the hinge to stop the rotational motion between the handle and the jaw.

DETAILED DESCRIPTION

The present disclosure provides a hinge assembly. The hinge assembly can be applied to a tool that has a first acting member and a second member. The hinge assembly includes a hinge and a detent cover. The hinge is pivotally connected a first acting member to a second acting member of the tool. The detent cover can cover the hinge to stop the rotational motion between the first acting member and the second acting member. Therefore, the user can drive the different positions of the work piece.

Figure 1:
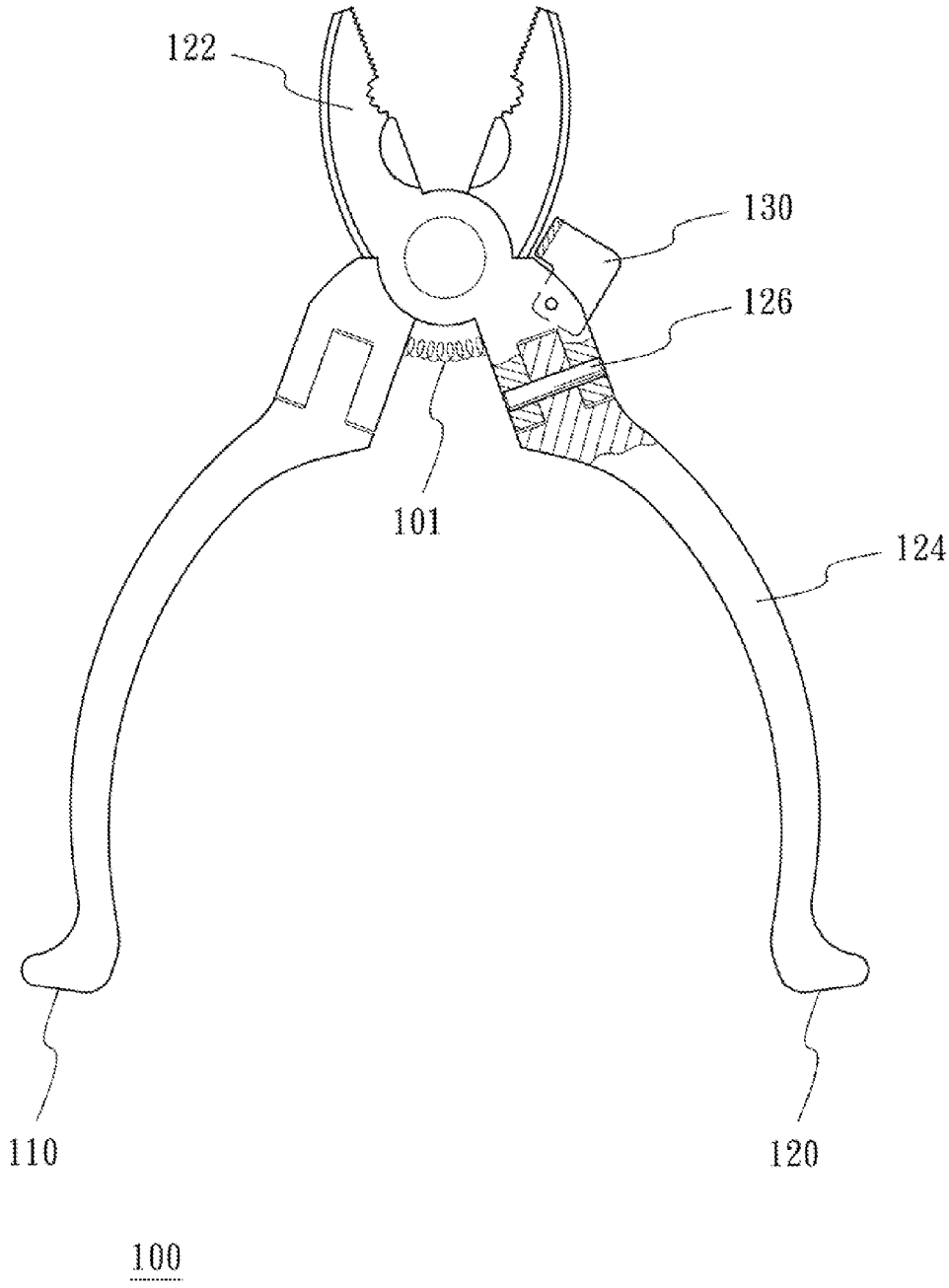
FIG. 1 is a front view of a pair of pliers according to one embodiment.
Figure 2:
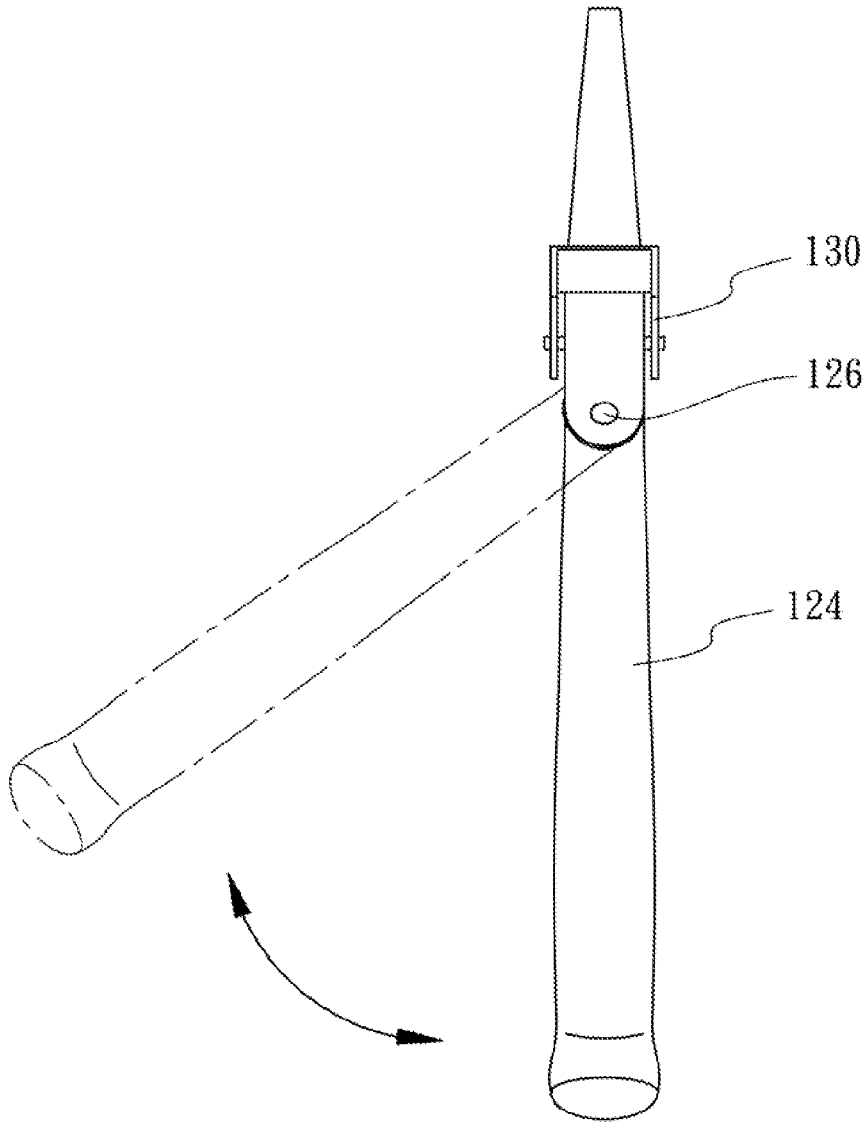
FIG. 2 is a side view of the pair of pliers of FIG. 1.

FIG. 1 is a front view of a pair of pliers 100 according to one embodiment, wherein the hinge assembly is applied to the pair of pliers 100. FIG. 2 is a side view of the pair of pliers 100 of FIG. 1. The pair of pliers 100 includes a first lever 110, a second lever 120 and at least one detent cover 130. The second lever 120 is pivotally connected to the first lever 110. The second lever 120 includes a jaw 122, a handle 124 and a hinge 126. The hinge 126 pivotally connects the jaw 122 to the handle 124. The detent cover 130 is pivotally connected to the jaw 122 of the second lever 120. The detent cover 130 can cover the hinge 126 to stop the rotational motion between the handle 124 and the jaw 122.

Figure 3:
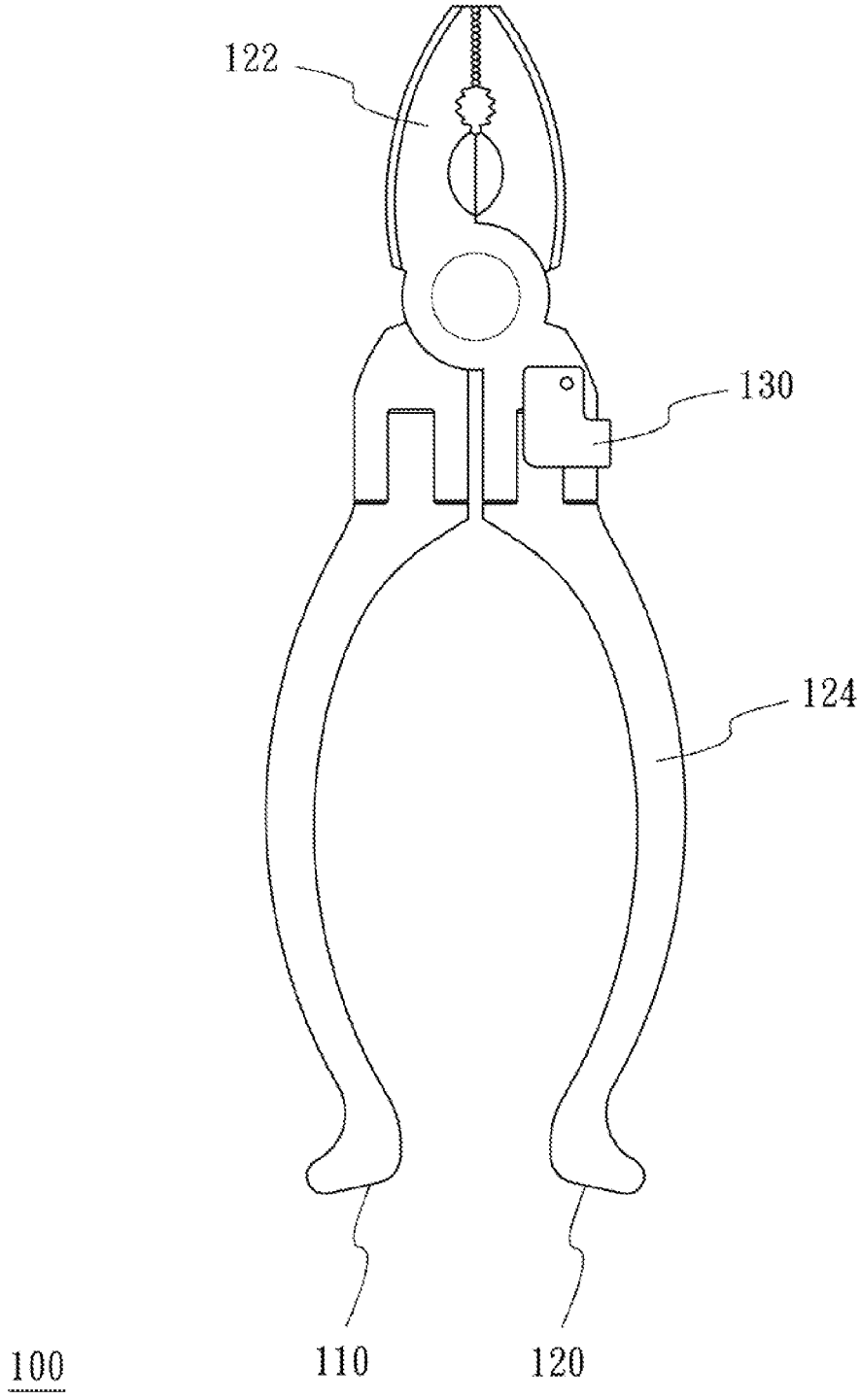
FIG. 3 is a front view of the pair of pliers of FIG. 1 in use.

FIG. 3 is a front view of the pliers 100 of FIG. 1 in use. In use, the user can cover the detent cover 130 to the hinge 126 from the outer side of the second lever 120. Therefore, when the user drives the work piece with the pair of pliers 100, the handle 124 and the jaw 122 can't be pivoted.

In addition, the pair of pliers 100 of FIG. 1 further includes a spring 101. The spring 101 restorably connects the first lever 110 and the second lever 120.

Figure 4:
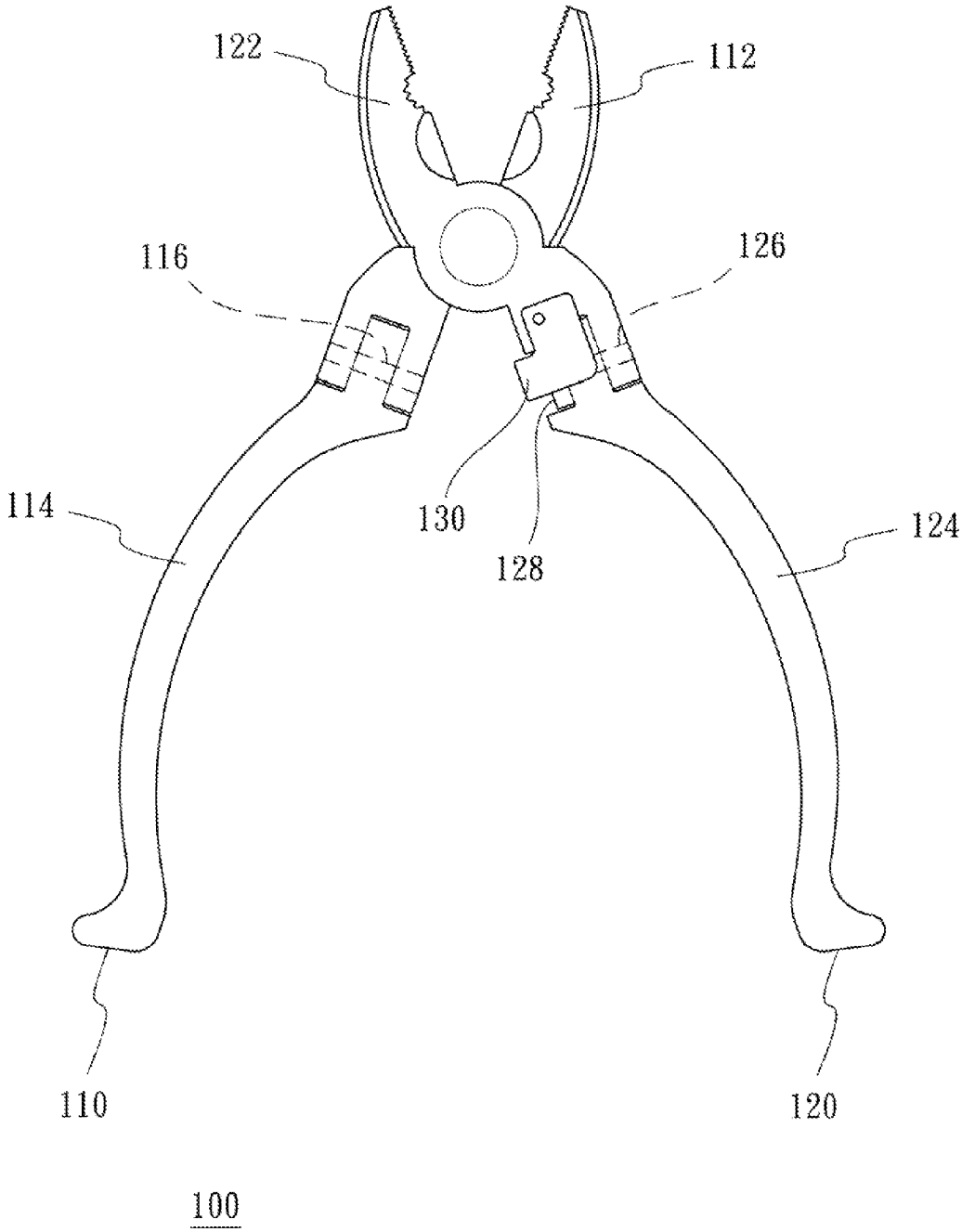
FIG. 4 is a front view of a pair of pliers according to another embodiment.

FIG. 4 is a front view of a pair of pliers 100 according to another embodiment. In FIG. 4, the first lever 110 of the pair of pliers 100 also includes a jaw 112, a handle 114 and a hinge 116. The hinge 116 pivotally connects the jaw 112 to the handle 114. Therefore, it is more practical for the user to adjust the acting angle with both the first lever 110 and the second lever 120.

In FIG. 4, the detent cover 130 is positioned to cover the hinge 126 from the inner side of the second lever 120. The second level 120 further includes a cover slot 128. When the detent cover 130 is covered the hinge 126, the detent cover 130 can be positioned in the cover slot 128. Therefore, the detent cover 130 would not protrude from the inner side of the second lever 120.

Figure 5:
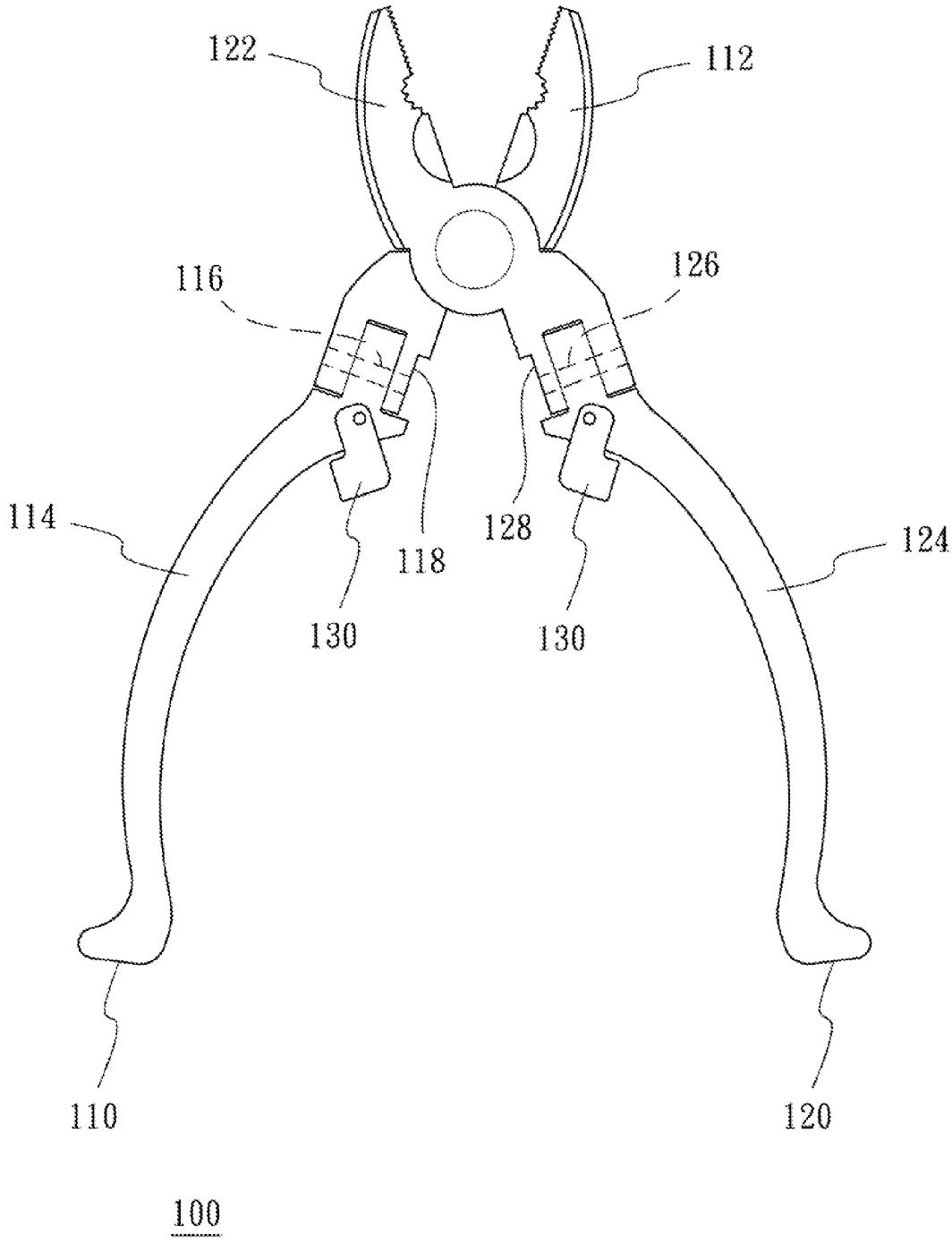
FIG. 5 is a front view of a pair of pliers according to yet another embodiment.
Figure 6:
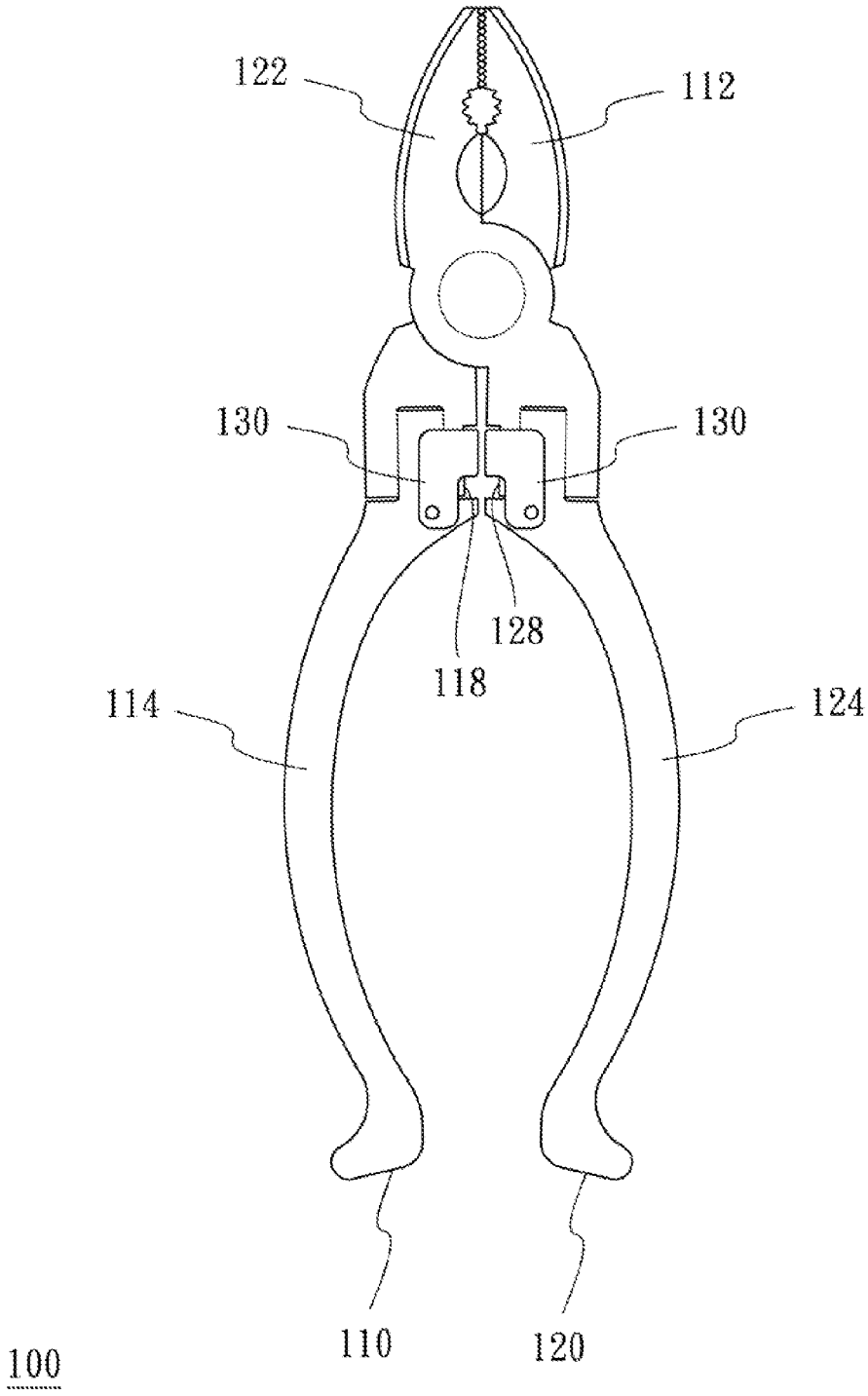
FIG. 6 is a front view of the pair of pliers of FIG. 5 in use.

FIG. 5 is a front view of a pair of pliers 100 according to yet another embodiment. FIG. 6 is a front view of the pair of pliers 100 of FIG. 5 in use. In FIG. 5 and FIG. 6, two detent covers 130 are pivotally connected to the handle 114 of the first lever 110 and the handle 124 of the second lever 120 respectively. The detent covers 130 are positioned to cover the hinges 116, 126 from the inner side of the first lever 110 and the inner side of the second lever 120 respectively. The rotational motion between the handle 114 and jaw 112 of the first lever 110 and the handle 124 and the jaw 122 of the second lever 120 can be arrested by the detent covers 130.

In addition, the first level 110 and the second level 120 each includes a cover slot 118, 128. Therefore, the detent covers 130 can be positioned in the cover slots 118, 128 respectively.

Figure 7:
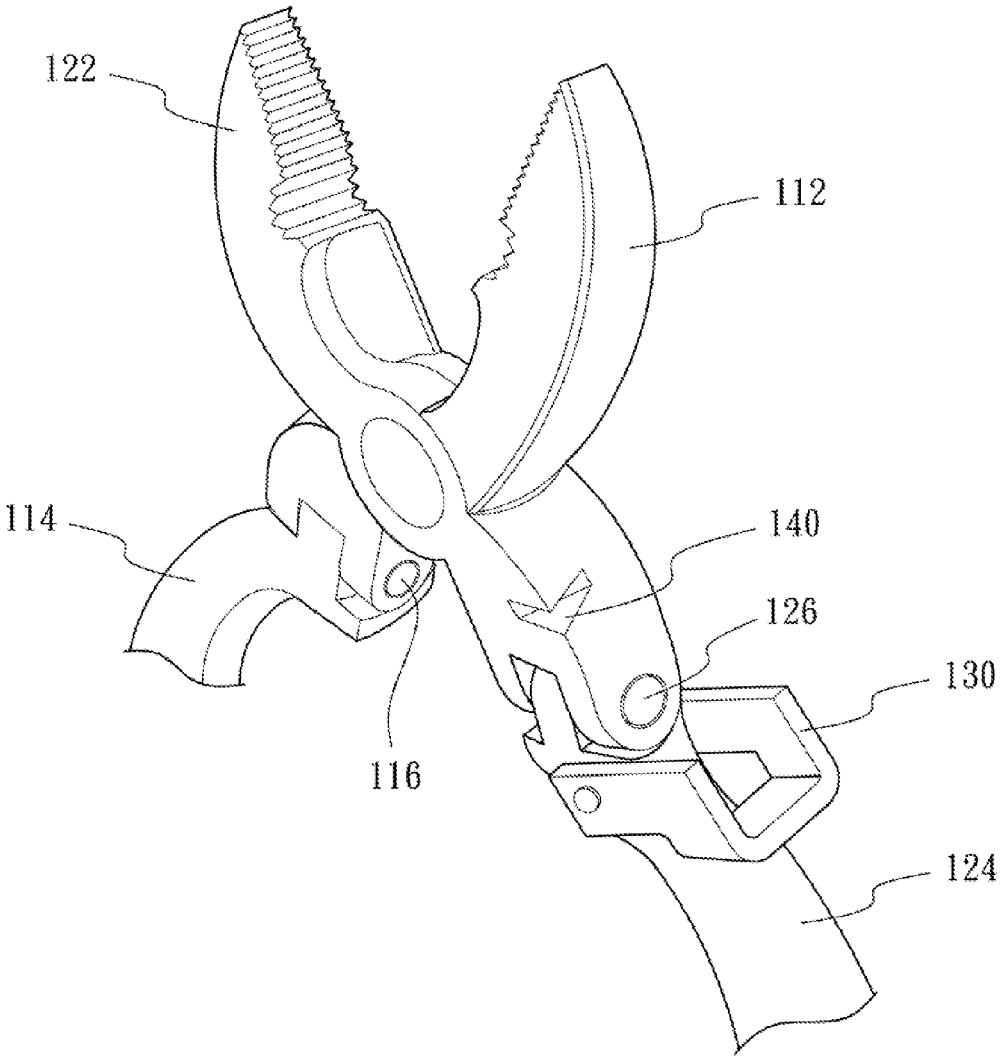
FIG. 7 is a three dimensional of a pair of pliers according to still another is embodiment.

FIG. 7 is a three dimensional view of a pair of pliers 100 according to still another embodiment. In FIG. 7, the pair of pliers 100 further includes a slot 140. The slot 140 is located in the side surface of the second lever 120. In detail, the slot 140 is located in the side surface of the jaw 122. The slot 140 can mesh the detent cover 130 when the jaw 122 and the handle 124 reach a predetermined angle relative to each other.

Figure 8:
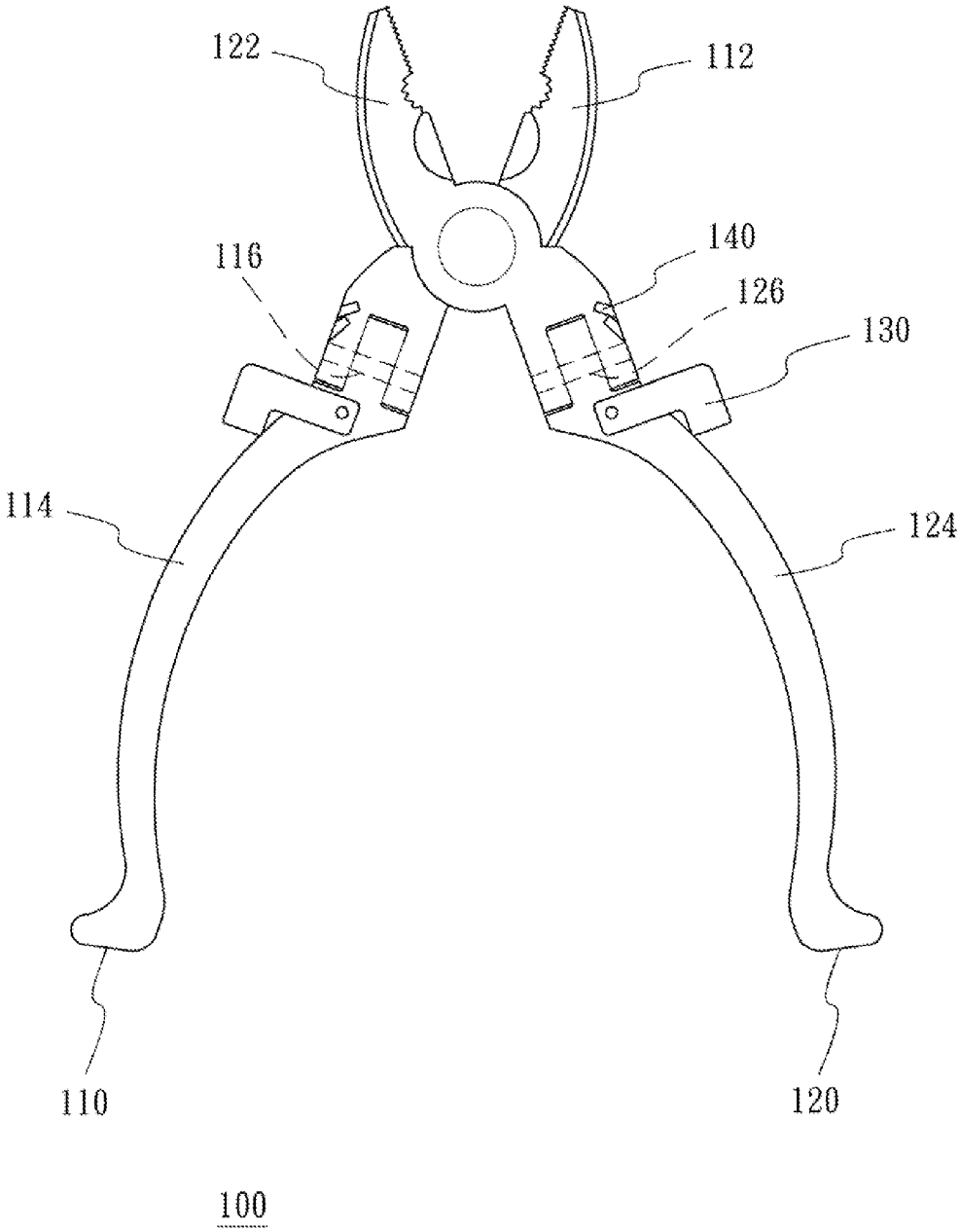
FIG. 8 is a front view of a pair of pliers according to yet another embodiment.

FIG. 8 is a front view of a pair of pliers 100 according to yet another embodiment. In FIG. 8, the pair of pliers 100 includes a plurality of the slots 140. The slots 140 are located in the side surface of the first lever 110 and the second lever 120. In use, the user can mesh the detent covers 130 by the slots 140.

Both of the first lever 110 and the second lever 120 include two slots 140. Therefore, the user can set different predetermined angles between the jaw 112 and the handle 114 of the first lever 110 and the jaw 122 and the handle 124 of the second lever 120.

Figure 9:
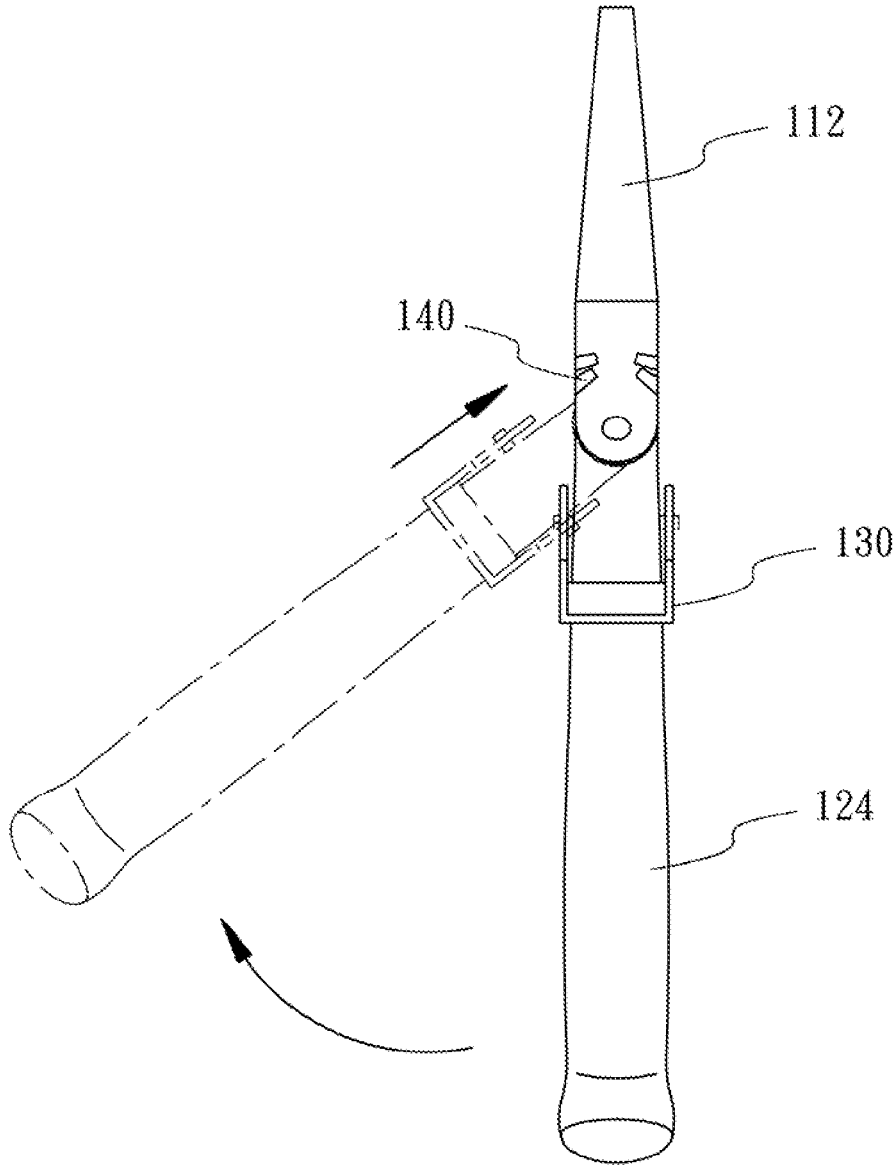
FIG. 9 is a side view of the pair of pliers of FIG. 8.
Figure 10:
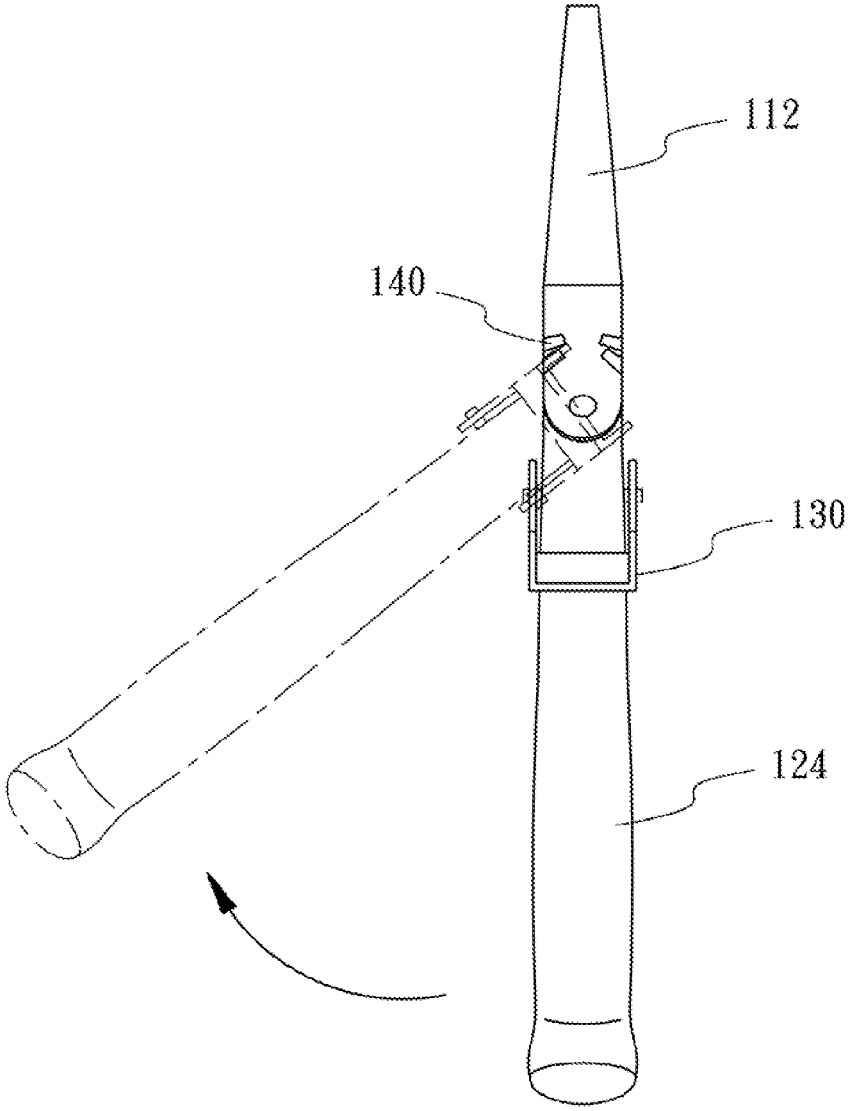
FIG. 10 is a side view of the pair of pliers of FIG. 8.

FIG. 9 and FIG. 10 are side views of the pair of pliers 100 of FIG. 8. In detail, the user can rotate the handle 124 of the second lever 120 to a predetermined angle relative to the jaw 122 of the second lever 120. Then, the user can mesh the detent cover 130 in one of the slots 140. Therefore, the predetermined angle between the jaw 122 and the handle 124 is stably set.

Figure 11:
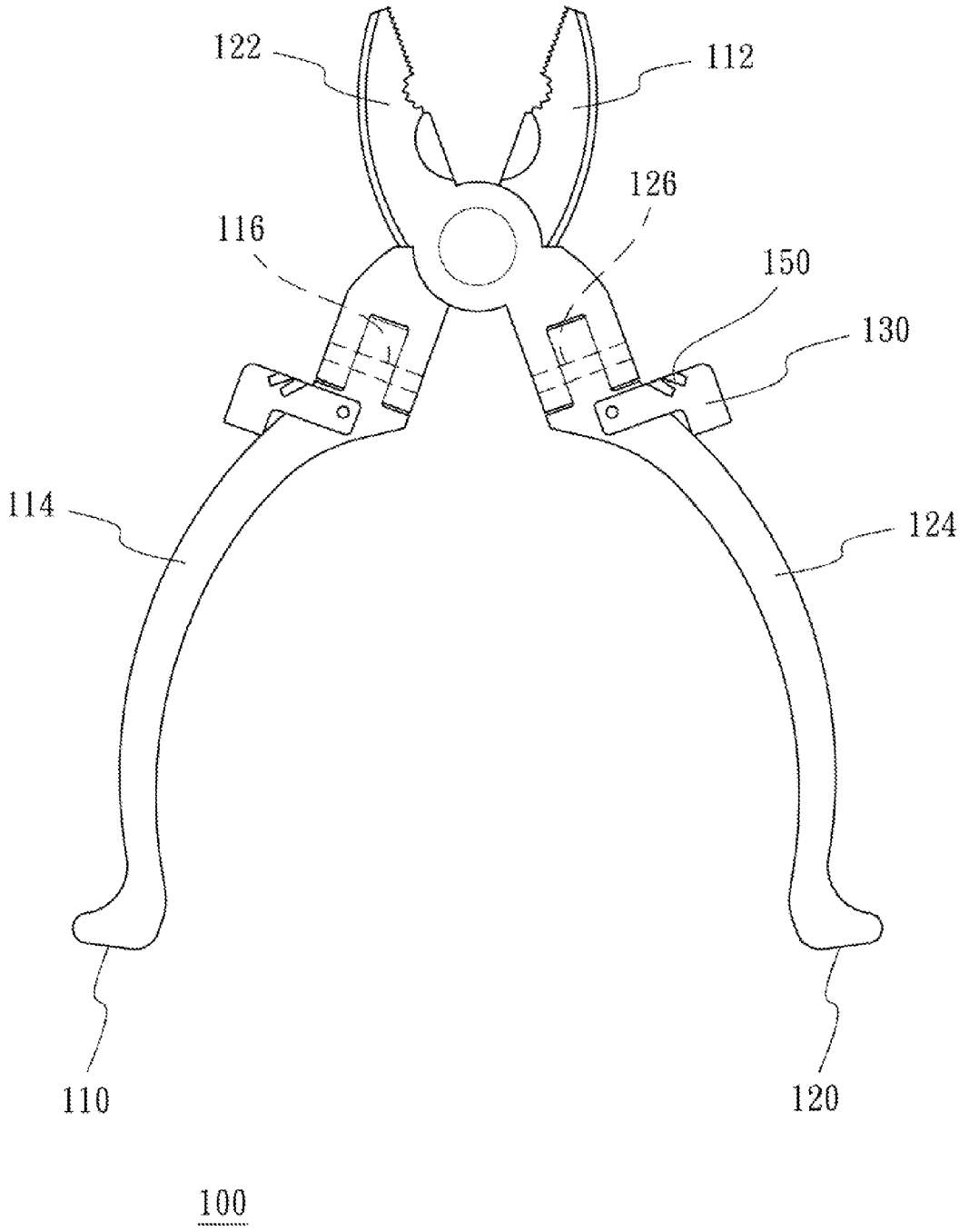
FIG. 11 is a front view of the pair of pliers according to still another embodiment.

FIG. 11 is a front view of the pair of pliers 100 according to still another embodiment. In FIG. 11, the pair of pliers 100 further includes a plurality of the slots 150. The slots 150 are located in the detent covers 130. The slot 150 can mesh the second lever 120 when the jaw 122 and the handle 124 reach a predetermined angle relative to each other. In addition, the slot 150 also can mesh the first lever 110 when the jaw 112 and the handle 114 reach a predetermined angle relative to each other.

Figure 12:
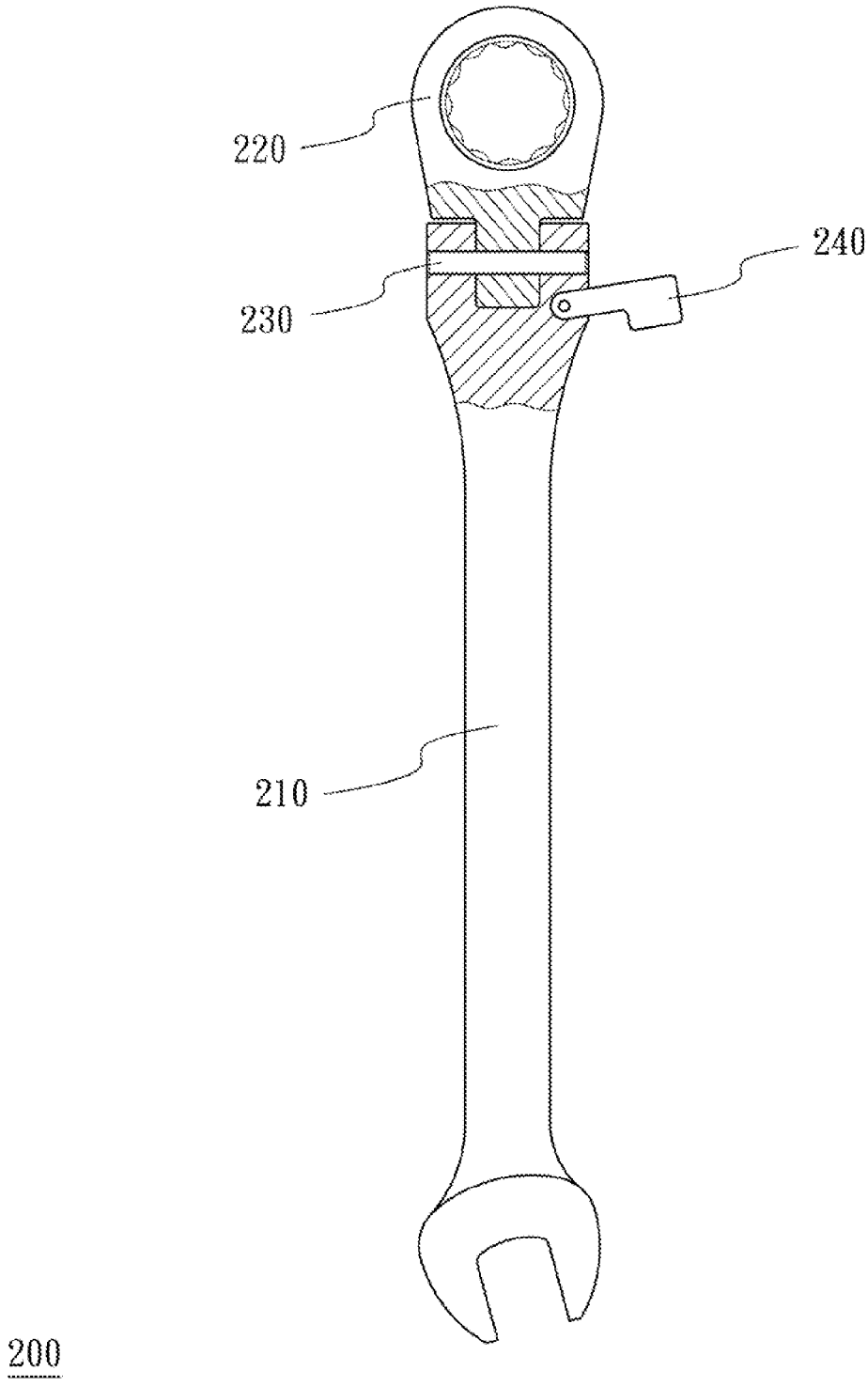
FIG. 12 is a front view of a hand tool according to yet another embodiment.
Figure 13:
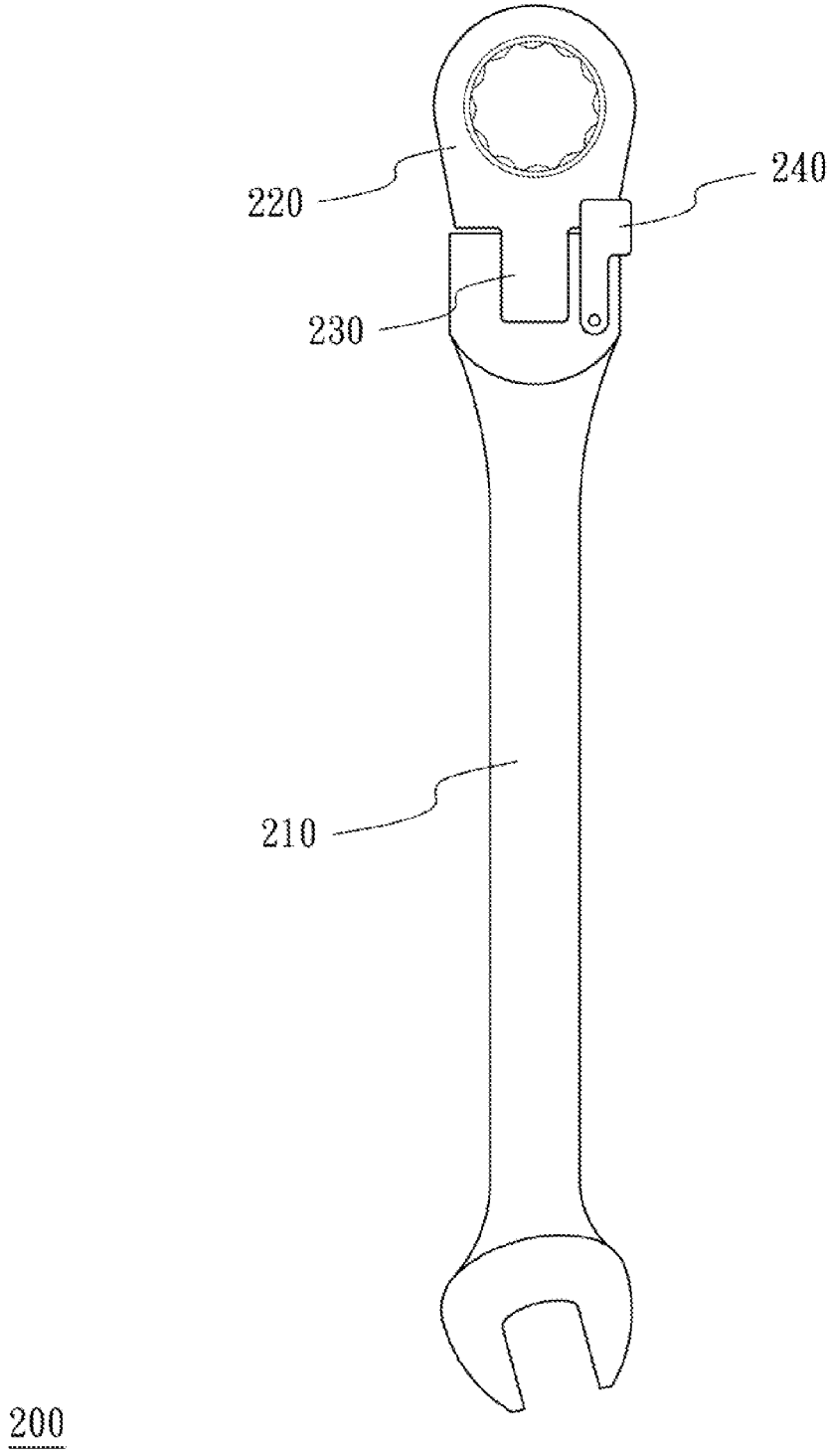
FIG. 13 is a front view of the hand tool of FIG. 12 in use.

FIG. 12 is a front view of a hand tool according to yet another embodiment, wherein the hinge assembly is applied to the hand tool such as a wrench 200. FIG. 13 is a front view of the hand tool of FIG. 12 in use. The wrench 200 includes a handle 210, an acting member 220, a hinge 230 and a detent cover 240. The hinge 230 pivotally connects the handle 210 to the acting member 220. The detent cover 240 is pivotally connected to the handle 210. In use, the detent cover 240 can cover the hinge 230 to stop the rotational motion between the handle 210 and the acting member 220.

Figure 14:
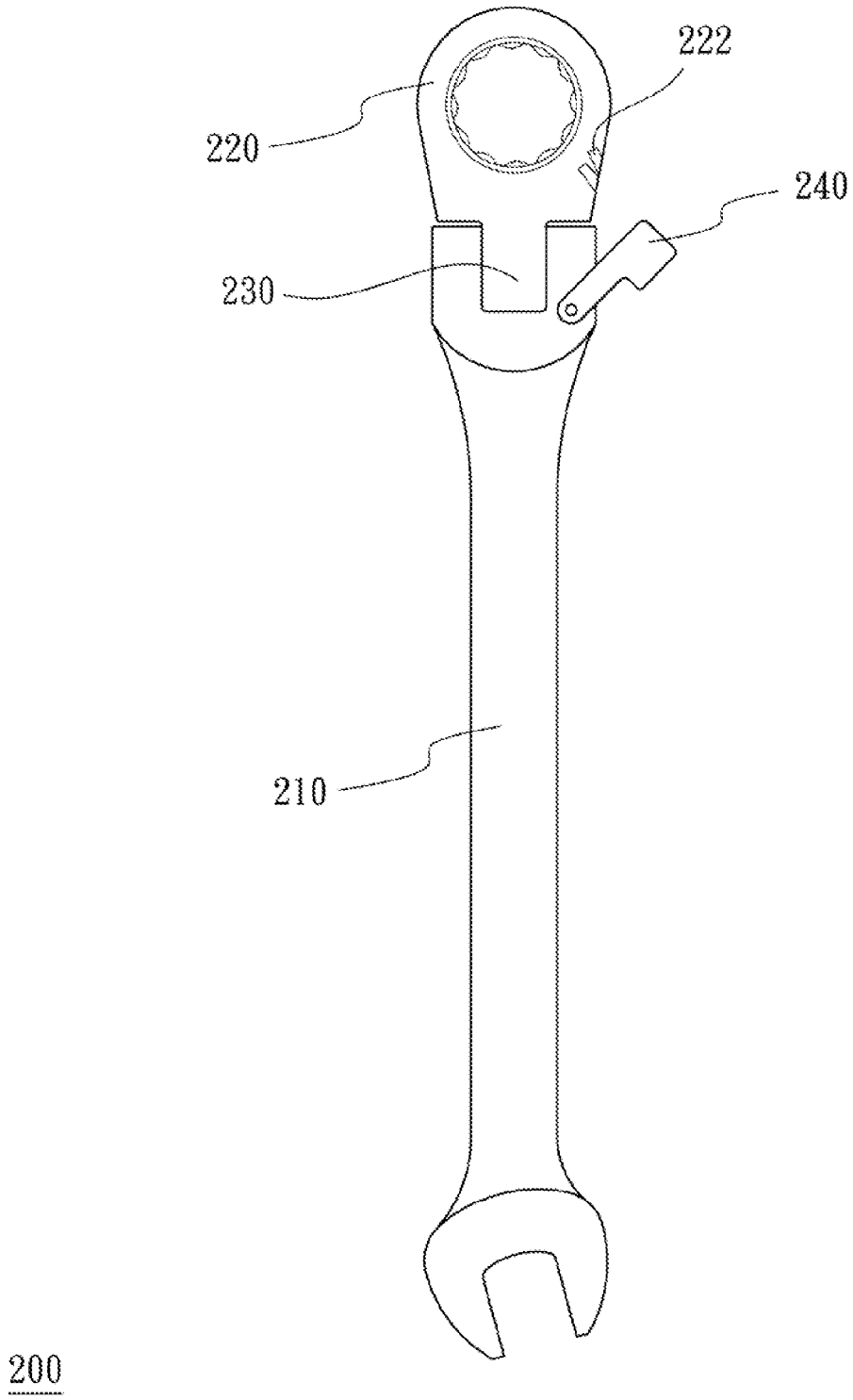
FIG. 14 is a front view of the hand tool according to still another embodiment.

FIG. 14 is a front view of the hand tool according to still another embodiment. In FIG. 14, the wrench 200 further includes a plurality of the slots 222. The slots 222 are located in the side surface of the acting member 220. The slots 222 can mesh the detent cover 240 when the acting member 220 and the handle 210 reach a predetermined angle relative to each other.

Figure 15:
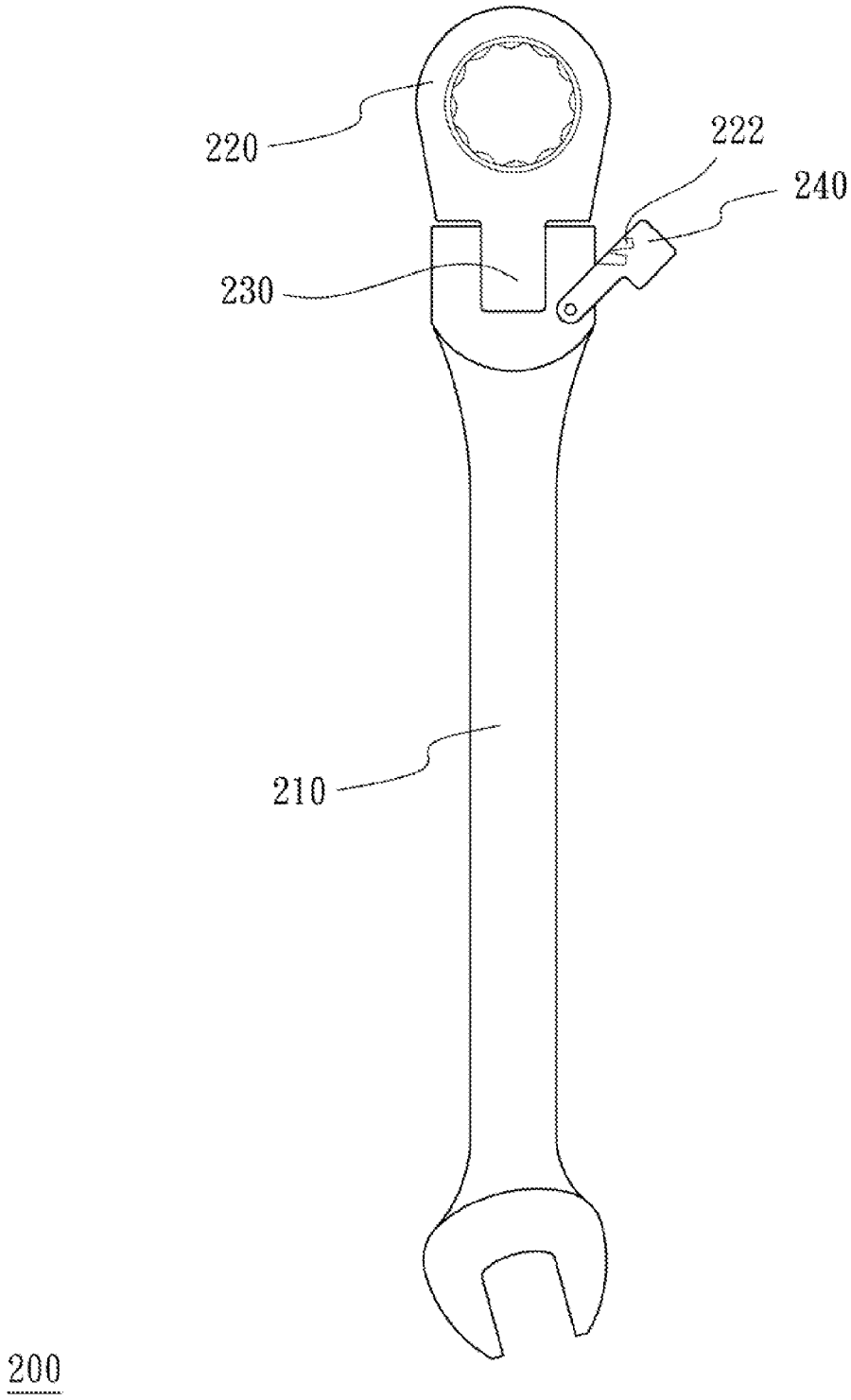
FIG. 15 is a front view of the hand tool according to yet another embodiment.

FIG. 15 is a front view of the hand tool 200 according to yet another embodiment. In FIG. 15, the wrench 200 further includes a plurality of the slots 222. The slots 222 are located in the detent cover 240 for meshing the acting member 220 when the acting member 220 and the handle 210 reach a predetermined angle relative to each other.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A pair of pliers comprising:

a first lever;

a second lever pivotally connected to the first lever, the second lever comprising:

a jaw;

a handle; and a hinge for pivotally connecting the jaw to the handle; and at least one detent cover comprising a U-shaped trough for covering the hinge to stop the rotational motion between the handle and the jaw.

2. The pair of pliers of claim 1, wherein the detent cover is pivotally connected to the second lever.

3. The pair of pliers of claim 1, further comprising:

at least one slot located in the side surface of the second lever for meshing the detent cover when the jaw and the handle reach a predetermined angle relative to each other.

4. The pair of pliers of claim 3, wherein a plurality of the slots are located in the side surface of the second lever.

5. The pair of pliers of claim 1, further comprising:

at least one slot located in the detent cover for meshing the second lever when the jaw and the handle reach a predetermined angle relative to each other.

6. The pair of pliers of claim 5, wherein a plurality of the slots are located in the detent cover.

7. The pair of pliers of claim 1, wherein the detent cover is positioned to cover the hinge from the outer side or inner side of the second lever.

8. The pair of pliers of claim 1, wherein the detent cover is pivotally connected to the jaw of the second lever.

9. The pair of pliers of claim 1, wherein the detent cover is pivotally connected to the handle of the second lever.

10. The pair of pliers of claim 1, wherein the first lever comprises:

a jaw;

a handle; and a hinge for pivotally connecting the jaw to the handle, wherein a plurality of the detent covers are positioned to cover the hinge of the first lever and the hinge of the second lever.

* * * * *